US006183102B1

(12) United States Patent
Mortz et al.

(10) Patent No.: US 6,183,102 B1
(45) Date of Patent: Feb. 6, 2001

(54) APPARATUS AND METHOD FOR PRODUCING A TRANSPARENT TUBULAR MEMBER CONTAINING A PHOSPHORESCENT MATERIAL

(75) Inventors: Bradford K. Mortz, Troy; Robert H. Miller, Canton, both of MI (US)

(73) Assignee: Global Products Sales and Marketing, L.L.C., Troy, MI (US)

( * ) Notice: Under 35 U.S.C. 154(b), the term of this patent shall be extended for 0 days.

(21) Appl. No.: 09/267,034

(22) Filed: Mar. 12, 1999

(51) Int. Cl.[7] ..... F21K 2/00
(52) U.S. Cl. ..... 362/84; 362/260; 362/800
(58) Field of Search ..... 362/84, 260, 800, 362/227; 313/485, 483

(56) References Cited

U.S. PATENT DOCUMENTS

| | | | | |
|---|---|---|---|---|
| 2,644,113 | * | 6/1953 | Etzkorn | 362/84 |
| 4,209,823 | * | 6/1980 | Burkdoll | 362/84 |
| 4,755,324 | | 7/1988 | Lindmayer . | |
| 4,759,453 | | 7/1988 | Paetzold . | |
| 4,818,434 | | 4/1989 | Lindmayer . | |
| 4,884,990 | | 12/1989 | Lovik . | |
| 5,043,096 | | 8/1991 | Lindmayer . | |
| 5,102,579 | | 4/1992 | Inaho et al. . | |
| 5,406,463 | | 4/1995 | Schexnayder, Sr. . | |
| 5,649,757 | | 7/1997 | Aleman et al. . | |
| 5,650,094 | | 7/1997 | Royce et al. . | |
| 5,775,016 | * | 7/1998 | Chien | 40/544 |
| 5,961,072 | * | 10/1999 | Bodle | 362/84 |
| 5,967,638 | * | 10/1999 | Gorman, Jr. et al. | 362/84 |

* cited by examiner

*Primary Examiner*—Thomas M. Sember
(74) *Attorney, Agent, or Firm*—Gifford, Krass, Groh, Sprinkle, Anderson & Citkowski, P.C.

(57) ABSTRACT

A transparent tubular member containing a phosphorescent material providing a degree of persistent illumination. The tubular member includes a first end and a second end, an outer diameter and an inner diameter establishing between the outer diameter a selected thickness. A volume of the phosphorescent material is encapsulated within the elongate tubular member and is responsive to an irradiating light source to charge the phosphorescent material to a desired degree of luminescence and so that the tubular member emits the luminescence of the phosphorescent material over a period of time.

12 Claims, 3 Drawing Sheets

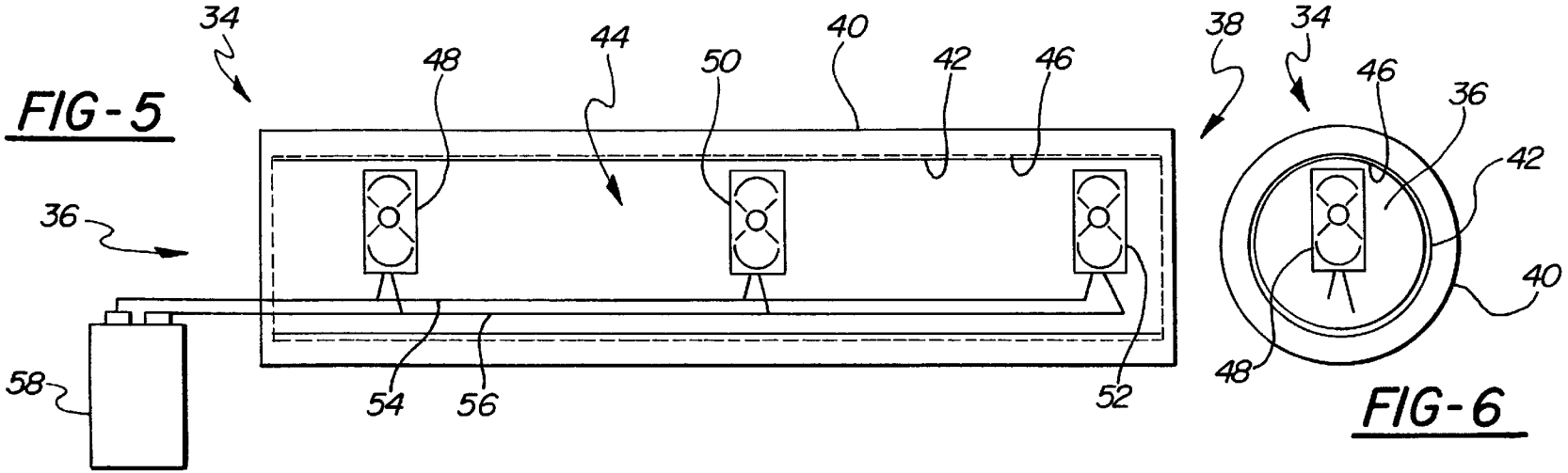
FIG-5
FIG-6
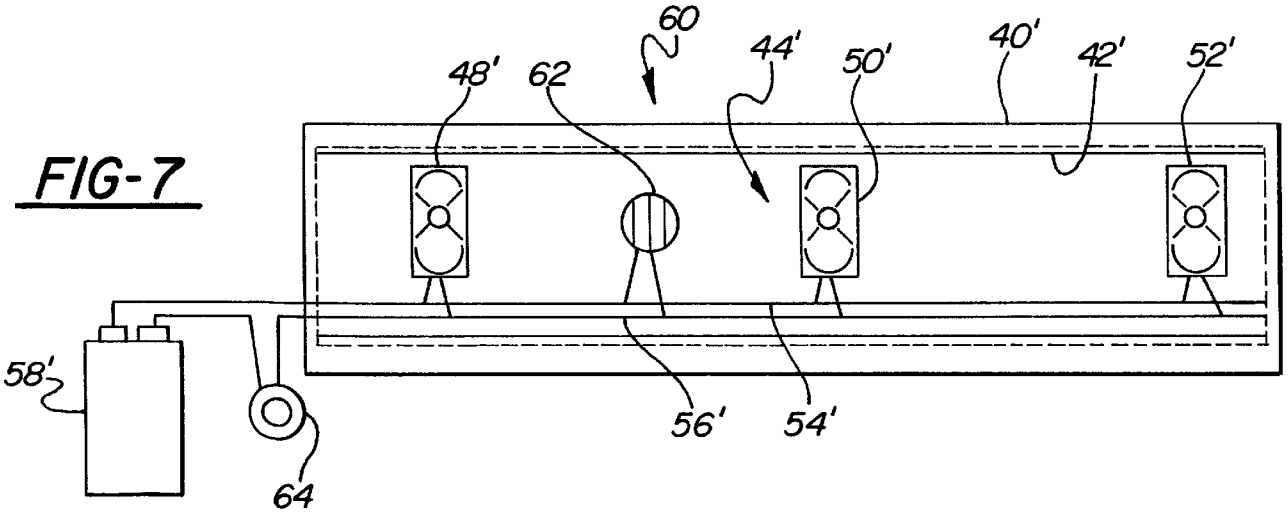
FIG-7
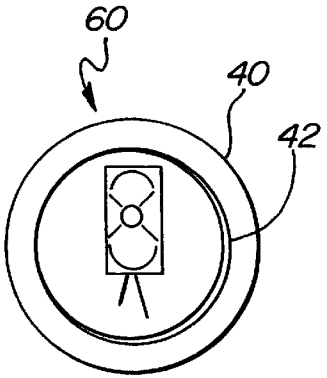
FIG-8

APPARATUS AND METHOD FOR PRODUCING A TRANSPARENT TUBULAR MEMBER CONTAINING A PHOSPHORESCENT MATERIAL

BACKGROUND OF THE INVENTION

1. Field of the Invention

The present invention relates generally to applicational uses of phosphor based materials and, more specifically, to an apparatus and method for producing a transparent tubular member containing a phosphorescent material or long persistent phosphorent (LPP) material, which is capable of being employed in a variety of different ways.

2. Description of the Prior Art

Various types of phosphor materials are well known in the art and which provide varying degrees of persistent luminescence. A common objective of phosphor materials is to provide an application for a luminescent light source which takes advantage of intermittent light irradiation and/or the absence of irradiating light on a continuous basis.

Examples of high luminescent phosphors are disclosed in such prior art references as U.S. Pat. No. 5,102,579, issued to Inaho et al., U.S. Pat. No. 5,043,096, issued to Lindmayer, and U.S. Pat. No. 5,650,094, issued to Royce et al. Each of the above references discloses a phosphor material which provides a degree of persistent lumination following exposure to an irradiating light source and which can be conveniently provided in a powderized or granulated form. The phosphor of Royce '094 is particularly noteworthy in that it discloses a long-decay red phosphor, such preceding persistent phosphors typically being of a green or lime-green color.

While the existence of phosphor materials such as above is fairly well known in the art, the recent trend has been to identify useful applications of persistent phosphor which will enable the production of sufficient light illumination following an iterative period of light irradiation. U.S. Pat. No. 4,884,990, issued to Lovik, discloses a luminescent balloon and method of manufacture in which luminescent dray solid particles are maintained in a latex carrier and constitute at least fifty percent to seventy five percent of the total dry solid of the inner lamination for imparting luminescent qualities to the balloon. U.S. Pat. No. 4,759,453, issued to Paetzold, discloses a luminescent baby bottle marked with a luminescent marker for use by a baby or infant. The marker is a band of synthetic plastic with a pigment of inorganic zinc sulfide phosphor with double activators. The band is further disclosed as being cylindrical and the bottle is blown within the band.

SUMMARY OF THE PRESENT INVENTION

The present invention is a transparent tubular member containing a volume of a phosphorescent material, and particularly such as a phosphor exhibiting a degree of long persistence, which is useful for numerous applications. The tubular member is constructed of a plastic, plasticized resin or vinyl material and includes a first end, a second end, an outer diameter and an inner diameter which establishes between the outer diameter a specified annular thickness. The tubular member typically has an internally open core and may or may not be closed at the first and second ends. The tubular member does exhibit a degree of flexibility and resiliency and is preferably produced in a conventional extrusion process.

A volume of a phosphorescent material exhibiting a degree of long-persistence, such as previously described, is encapsulated within the tubular member for the purpose of establishing a degree of persistent luminescence. In a first embodiment, encapsulating is accomplished by introducing the phosphor material, typically provided in a powder or granulated form, in a water or other fluid based slurry mixture and under a degree of pressure so that it coats the inwardly annular facing wall defined by the inner diameter. The benefit of the slurry process is that it applies a relatively thin layer of phosphor which saves on material expense and still provides an effective work application while maintaining the desired degree of flexibility of the tubular member.

In a further preferred embodiment, additional inner and outer coaxial layers of clear/non-phosphorant encapsulated tubing are co-extruded in simultaneous fashion over the phosphorescent encapsulated tubular member so as to produce a robust tubular member which is capable of withstanding more demanding applicational uses. A still further embodiment discloses installing a plurality of light emitting diodes (L.E.D.'s) at spaced intervals within the open interior of the tubular member, connecting the diodes by means of at least one common electrical wire, and connecting the wire(s) to a power supply, such as a battery, which provides intermittent flashing of the diodes to recharge the luminescent capabilities of the phosphorescent based material. A yet further variation of this embodiment further contemplates the provision of a processor based circuit including a photocell element for timing the intermittent flashing of the diodes so as to recharge the luminescence of the phosphor material at desired intervals.

A yet further embodiment discloses severing the elongate tubular member into first and second cross sectional halves. The first half includes the encapsulated phosphorescent material either coated to the inner walls or preferably impregnated within the material content of the wall thickness. A thin, elongate and flexible reflector element is mounted within the semi-cylindrical open core defined by the elongate extending first cross sectional half. The second half is a clear, non-encapsulated material, which is fused to the first half to reassemble the complete tubular member. The resulting combination causes the reflector to bounce the light waves both externally as well as into the phosphorescent material, with the result being that additional luminescent capabilities are achieved.

The present invention also discloses a method of constructing a tubular member containing a phosphorescent material including the steps of extruding at least one layer of a transparent tubular member selected from a group of materials including a plastic, plasticized resin and vinyl. Also included is the step of encapsulating a volume of phosphorescent material exhibiting a degree of persistent luminescence within the tubular member such that the material emits a prolonged degree of luminescence following a period of exposure to an irradiating light source. Additional steps of encapsulating the tubular member with a slurry mixture containing the phosphorescent material, co-extruding at least one additional tubular member in coaxial fashion, and without an encapsulated volume of phosphor, around the phosphor encapsulated tubular member, and iteratively recharging the degree of luminescence of the phosphorescent material, are also disclosed.

BRIEF DESCRIPTION OF THE DRAWINGS

Reference will now be made to the attached drawings, when read in combination with the following specification, wherein like reference numerals refer to like parts throughout the several views, and in which:

FIG. 5 is a plan view of the phosphor encapsulated tubular member according to a third preferred embodiment of the present invention;

FIG. 6 is an end view of the embodiment of FIG. 5;

FIG. 7 is a plan view of the phosphor encapsulated tubular member according to a fourth preferred embodiment of the present invention;

FIG. 8 is an end view of the embodiment of FIG. 7;

DESCRIPTION OF THE PREFERRED EMBODIMENTS

Figure 1:
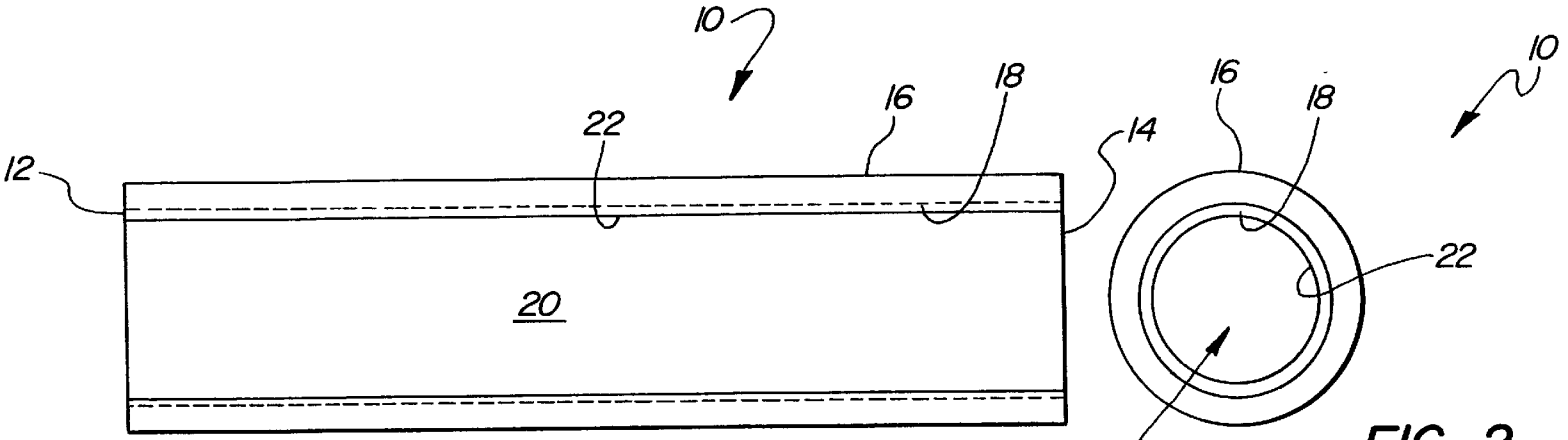
FIG. 1 is a plan view of the phosphor encapsulated tubular member according to a first preferred embodiment of the present invention.
Figure 2:
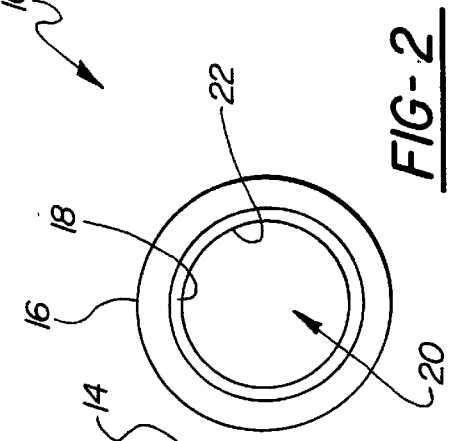
FIG. 2 is an end view of the embodiment of FIG. 1.

Referring now to FIGS. 1 and 2, an elongate tubular member containing a phosphorescent material is illustrated at 10 according to a first preferred embodiment of the present invention. The tubular member is constructed of a plastic, plasticized resin/polymer or, more specifically, vinyl material and includes a first end 12, a second end 14, an outer diameter 16 and an inner diameter 18 which establishes between the outer diameter 16 a selected annular thickness. Within the inner diameter wall 18 of the tubular member 10 is defined an internally open core 20 and the first and second ends 12 and 14 of the member may be open or closed depending upon the specified manufacturing process and application to be subsequently described.

A volume of a desired phosphorescent material is applied to the tubular member 10, specifically in some fashion so that it is encapsulated at least within its outer diameter 16 and so as to protect against decay or degradation of the phosphor. As was previously described, the availability of phosphor materials is known in the art and need not be further described herein, such phosphors typically being produced in a powderized or granulated form, in colors such as green or red, and possessing a degree of persistent luminescent capabilities, i.e., the ability to emit a constant colorized glow in response to an irradiating light source and over any period of time. Additional advances in long-persistent phosphor materials are anticipated to further enhance the applicability and usefulness of the elongate tubular member according to the present invention.

According to the first preferred embodiment, the phosphor material is suspended within a slurry mixture of water or other base liquid material and which is forced through an open end of the tube under a specified degree of pressure so as to coat the entirety of the inner facing walls of the tubular member 10. The result, upon drying of the slurry mixture, is a dried layer 22 of phosphor material of a specified and relatively thin dimension and which adheres to the inner diameter wall 18 of the tubular member 10.

Figure 3:
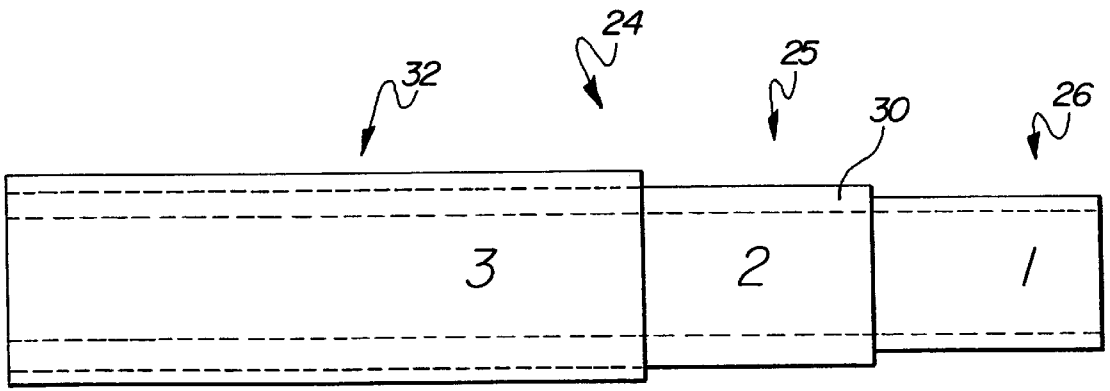
FIG. 3 is a plan view of the phosphor encapsulated tubular member according to a second preferred embodiment of the present invention.
Figure 4:
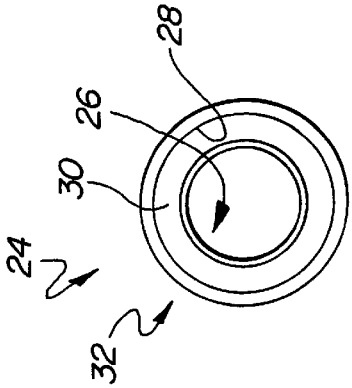
FIG. 4 is an end view of the embodiment of FIG. 3.

Referring further to FIGS. 3 and 4, a further preferred embodiment 24 of the present invention is illustrated and discloses a series of co-extruded layers of tubular members which combine to provide a durable phosphorescent tubular composite. Specifically, a first clear or non-encapsulated tubular member 26 is extruded and, simultaneously, a further tubular member 28 which is impregnated with the phosphorescent material 30 is co-extruded over the first tubular member 28. Simultaneously, a further likewise clear tubular member 32 is co-extruded over the tubular member 26 with the phosphor impregnation with the resultant tubular composite exhibiting robust applicational durability. It is also contemplated that a single inner or outer clear tubular layer may be provided in combination with the impregnated tubular composition or further that no additional clear tubular layers may be required depending upon the use requirements of the impregnated layer and its vulnerability to external elements which may act to decay the effectiveness of the phosphorant composition.

Referring further to FIGS. 5 and 6, a tubular member is shown at 34 according to a yet further preferred embodiment of the present invention and includes an elongate tubular member very similar in construction to that illustrated at 10 in FIGS. 1 and 2 having a first end 36, a second end 38, an outer diameter 40, and an inner diameter 42 establishing a desired thickness between the outer diameter 40 and an internal open core 44. The phosphorescent material, illustrated at 46, may be applied by either a slurry process such as was described in the first preferred embodiment, or as is also contemplated by the instant invention, may completely fill part or all of the interior open core. As was previously described, the phosphorescent material may also be impregnated within the annular wall thickness of the tubular material. Due to material considerations, it may however be desirable in the most preferred embodiments to either apply a thin coat to the inner diameter facing walls of the tubular member or again to impregnate the wall thickness during the initial extrusion or forming process.

A plurality of light emitting diodes (L.E.D.'s) are placed at specified distances within the elongate extending interior core 44 of the tubular member 34 and are illustrated by three selected diodes 48, 50 and 52. In a preferred embodiment, the spacing of the diodes 48, 50 and 52 is at twelve inch increments, however it is anticipated that other lineal spacings may be employed based upon the desired performance characteristics of the device. First and second communication lines 54 and 56 extend through the interior core 44 of the tubular member 34 and each diode 48, 50 and 52 separately connects to the communication lines 54 and 56. An external power source 58, such as a battery is connected to extending ends of the communication lead lines 54 and 56 and operates to iteratively flash the diodes. Other types of power sources are also not precluded by the present invention and it is contemplated that such as a small watch battery could be employed which is embedded within the tubular member interior.

The concept behind this embodiment is the ability to iteratively flash the diodes so as to effectuate re-charging of the luminescent capabilities of the phosphorescent material encapsulated within the tubular member and to cause the phosphor to emit light according to its color for a further period of time. Such an application as this is particularly useful at night-time following a persistent decay of the luminescent capabilities of the phosphor material originally charged during the fading daylight. Additional applications include indoors where it is desired to mark a location and where use of a constant power outlet source is impractical.

Referring now to FIGS. 7 and 8, a further variation 60 of the preferred embodiment of FIGS. 5 and 6 is shown and discloses the addition of a photocell element 62 which is encapsulated within the interior cavity 44' of the tubular member and which is likewise in electrical communication with the electrical feed lines 54' and 56'. The photocell element 62 is located along the array of the diodes 48', 50' and 52' and communicates with a processor circuit element 64, such as a mini-microprocessor circuit, so that upon the photocell 62 sensing a falling of ambient light below a preset value, the circuit 64 causes the battery source 58' to iteratively flash the diodes and to recharge the luminescent capabilities of the phosphor in the manner previously described.

Figure 9:
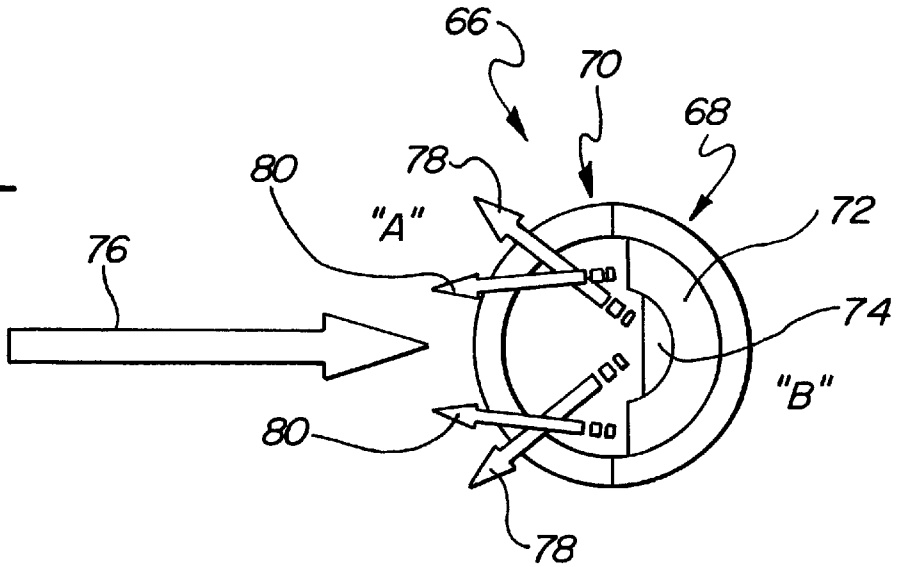
FIG. 9 is a plan view of the phosphor encapsulated tubular member according to a fifth preferred embodiment of the present invention.
Figure 10:
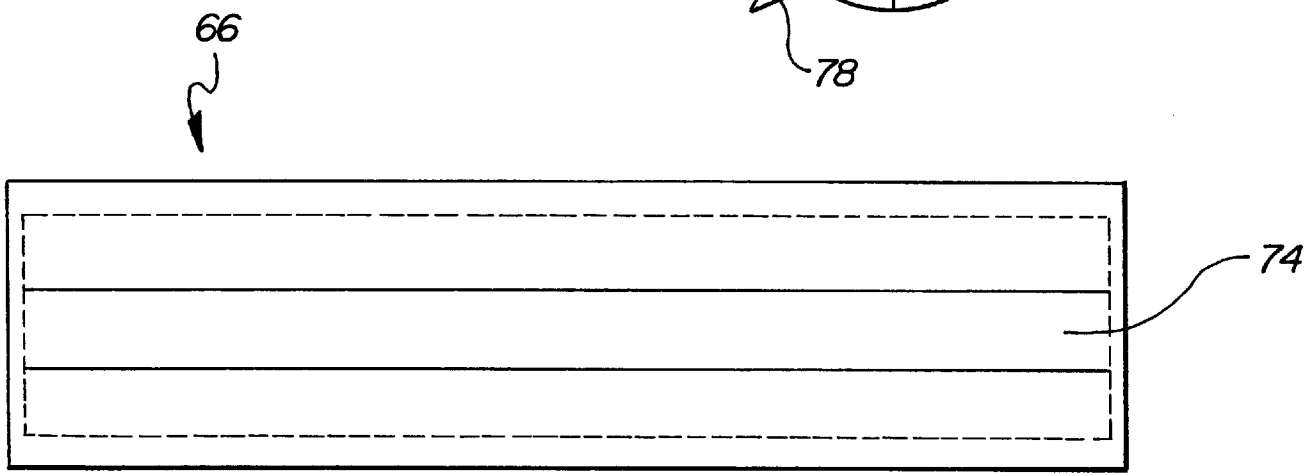
FIG. 10 is an end view of the embodiment of FIG. 9.

Referring finally to FIGS. 9 and 10, a further embodiment 66 of the present invention discloses a tubular member constructed of a first cross sectional half 68 and a second cross sectional half 70. The first half 68 is constructed of an encapsulated phosphor material, such as at 72, and includes a semi-cylindrical recess within which is mounted a flexible and elongate reflector element 74. The second cross sectional half 70 is constructed of a clear material without any phosphor and is fused to the first half 68 to close of the interior. The operation of the tubular member 66 is such that, upon experiencing a primary light irradiation, see line 76, incidental radiation beams 78 and 80 are caused, some of which reflect outwardly and some of which reflect into the phosphor encapsulated first half 68 so as to provide an enhanced degree of both reflectiveness and luminescent capability.

A method for constructing a tubular member containing a phosphorescent material is also disclosed which includes the steps of extruding at least one transparent tubular member selected from a group of materials including plastic, plasticized resin and vinyl and of encapsulating a volume of phosphorescent material within the extruded tubular material such that the material emits a prolonged degree of luminescence following a period of exposure to an irradiating light source. Additional steps include applying the phosphor material within a slurry mixture, co-extruding one or more additional layers of clear tubular members and iteratively recharging the level of luminescent capability of the phosphorescent material within the tubular member.

Having described our invention, it is evident that it discloses a tubular member containing a persistent phosphorescent material which is novel and useful in its applications. It is contemplated that the tubing may be manufactured in very long rolls or coils and that lengths of product from a single roll may be used in a variety of differing applications, such as in patios, basketball hoops, deck step edges, driveway edge markers and the like. It is also envisioned that a variety of different phosphorescent colors such as light green, red, orange and the like can also be encapsulated within the tubular member.

Reference is now made to the appended claims in combination with the preceding disclosure.

We claim:

1. A transparent tubular member containing a phosphorescent material, comprising:

an elongate tubular material having a first end and a second end, an outer diameter, an inner diameter establishing between said outer diameter a selected thickness, and an internally open core, said elongate tubular material exhibiting a specified degree of flexibility and comprising a vinyl composition;

a volume of a persistent phosphorescent material encapsulated within said elongate tubular member, said phosphorescent material being intermixed with said vinyl composition prior to formation of said tubular member; and said elongate tubular member further comprising a first extrusion of a transparent tubing over which is co-extruded said phosphorescent mixed tubular member, a further extrusion of a transparent tubing being co-extruded over said phosphorescent mixed tubular member.

2. The transparent tubular member according to claim 1, further comprising said volume of phosphorescent material being suspended within a slurry mixture, said slurry mixture being introduced in a pressurized application within said tubular material and coating an inwardly facing surface of said inner diameter between said first end and said second end.

3. The transparent tubular member according to claim 1, further comprising first and second electrical lines extending through said open core, a plurality of light emitting diodes being placed at specified distance intervals between said first end and said second end of said tubular member and in operative communication with said electrical lines, said electrical lines connecting to a power supply and providing iterative flashing of said diodes to recharge said phosphorescent material to a desired level of luminescence.

4. The transparent tubular member according to claim 1, said elongate tubular member comprising a first cross sectional half and a second cross sectional half, said first half including said encapsulized phosphorescent material, an elongate reflector element being mounted within a semi-cylindrical open core defined by said elongate extending first cross sectional half, said second cross sectional half being subsequently secured to said first cross sectional half.

5. A method of constructing a tubular member containing a phosphorescent material comprising the steps of:

extruding at least one transparent tubular member selected from a group of materials including plastic, plasticized resins and vinyl;

encapsulating a volume of a phosphorescent material within said extruded tubular material such that said material emits a prolonged degree of luminescence following a period of exposure to an irradiating light source;

placing a plurality of light emitting diodes at specified distance intervals between first and second ends of tubular member;

connecting said diodes to a power supply; and iteratively flashing said diodes to recharge a level of luminescence of said phosphorescent material within said tubular member.

6. The method of constructing a tubular member according to claim 5, further comprising the step of encapsulating said tubular member with a slurry mixture containing said volume of phosphorescent material.

7. The method of constructing a tubular member according to claim 5, further comprising the step of co-extruding at least one additional tubular member without said phosphorescent material in coaxial fashion with said phosphorescent encapsulated tubular member.

8. The method of constructing a tubular member according to claim 5, further comprising the step of iteratively recharging a level of luminescence of said phosphorescent material within said tubular member.

9. A transparent tubular member containing a phosphorescent material, comprising:

an elongate tubular material having a first end and a second end, an outer diameter, an inner diameter establishing between said outer diameter a selected thickness, and an internally open core, said elongate tubular material exhibiting a specified degree of flexibility;

a volume of a persistent phosphorescent material encapsulated within said elongate tubular member; and first and second electrical lines extending through said open core, a plurality of light emitting diodes being placed at specified distance intervals between said first end and said second end of said tubular member and in operative communication with said electrical lines, said electrical lines connecting to a power supply and providing iterative flashing of said diodes to recharge said phosphorescent material to a desired level of luminescence.

10. The transparent tubular member according to claim 9, further comprising a photocell element contained within said open core and in communication with said first and second electrical lines, said photocell element sensing a fall-off of said level of luminescence below a minimal programmed value and being in operative communication with a microprocessor circuit to activate said power supply to flash said diodes to recharge said phosphorescent material to said desired level of luminescence.

11. A transparent tubular member containing a phosphorescent material, comprising:

an elongate tubular material having a first end and a second end, an outer diameter, an inner diameter establishing between said outer diameter a selected thickness, and an internally open core, said elongate tubular material exhibiting a specified degree of flexibility;

a volume of a persistent phosphorescent material encapsulated within said elongate tubular member; and said elongate tubular member further comprising a first cross sectional half and a second cross sectional half, said first half including said encapsulated phosphorescent material, an elongate reflector element being mounted within a semi-cylindrical open core defined by said elongate extending first cross sectional half, said second cross sectional half being subsequently secured to said first cross sectional half.

12. The transparent tubular member according to claim 11, further comprising a further extrusion of a transparent tubing being co-extruded over said phosphorescent mixed tubular member.

* * * * *